US010161195B2

(12) United States Patent
Kartha et al.

(10) Patent No.: US 10,161,195 B2
(45) Date of Patent: Dec. 25, 2018

(54) LOW STRESS ROPE SOCKET FOR DOWNHOLE TOOL

(71) Applicant: Halliburton Energy Services, Inc., Houston, TX (US)

(72) Inventors: Nikhil Manmadhan Kartha, Singapore (SG); Mark S. Holly, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/327,402

(22) PCT Filed: Aug. 20, 2014

(86) PCT No.: PCT/US2014/051915
§ 371 (c)(1),
(2) Date: Jan. 19, 2017

(87) PCT Pub. No.: WO2016/028291
PCT Pub. Date: Feb. 25, 2016

(65) Prior Publication Data

US 2017/0204679 A1 Jul. 20, 2017

(51) Int. Cl.
*E21B 17/02* (2006.01)
*E21B 17/10* (2006.01)
*E21B 47/01* (2012.01)

(52) U.S. Cl.
CPC ..... *E21B 17/023* (2013.01); *E21B 17/1035* (2013.01); *E21B 47/01* (2013.01)

(58) Field of Classification Search
CPC ..... E21B 17/023; E21B 17/1035
See application file for complete search history.

(56) References Cited

U.S. PATENT DOCUMENTS 644,404 A * 2/1900 Christ et al. ..... A62B 1/06 188/65.4
2,266,883 A * 12/1941 Lukes ..... E21B 17/023 403/365

(Continued)

FOREIGN PATENT DOCUMENTS

| | | |
|---|---|---|
| GB | 1056990 | 2/1967 |
| WO | 2001-020129 | 3/2001 |
| WO | 2013-098280 | 7/2013 |

OTHER PUBLICATIONS

International Search Report and Written Opinion. Application No. PCT/US2014/051915; 9 pgs, dated May 28, 2015.

*Primary Examiner* — D. Andrews
*Assistant Examiner* — Tara E Schimpf
(74) *Attorney, Agent, or Firm* — Baker Botts L.L.P.

(57) ABSTRACT

In accordance with some embodiments of the present disclosure, a low stress rope socket for a downhole tool is disclosed. The rope socket includes a core, a groove cut in a helix shape on the core, and a rope wrapped around the core and inserted in the groove. The slickline attachment affixed to an uphole end of the core to attach the rope to the core. Additionally, the rope socket includes a housing surrounding the rope and the core. The housing secures the rope to the groove. The rope socket further includes a transition affixed to a downhole end of the core. The transition aligns the rope with an axis of symmetry of the socket. A portion of the rope downhole from the rope socket carries no load.

20 Claims, 7 Drawing Sheets

(56) References Cited

U.S. PATENT DOCUMENTS

| | | | | |
|---|---|---|---|---|
| 3,254,383 | A | 6/1966 | Ehmann | |
| 3,422,501 | A | 1/1969 | Yoshimura | |
| 4,901,804 | A | 2/1990 | Thometz et al. | |
| 5,366,018 | A | 11/1994 | Van Steenwyk et al. | |
| 5,526,552 | A * | 6/1996 | De Angelis | F16G 11/00 24/115 N |
| 6,039,325 | A | 3/2000 | Steinetz et al. | |
| 6,191,414 | B1 * | 2/2001 | Ogle | G01L 1/246 250/227.14 |
| 6,688,828 | B1 | 2/2004 | Post | |
| 6,691,776 | B2 | 2/2004 | Guillory et al. | |
| 6,854,164 | B2 | 2/2005 | Bass et al. | |
| 7,128,147 | B2 | 10/2006 | Marcin et al. | |
| 7,194,902 | B1 | 3/2007 | Goodwin et al. | |
| 8,096,024 | B2 | 1/2012 | Smith et al. | |
| 8,375,527 | B1 | 2/2013 | Crow et al. | |
| 8,950,472 | B2 * | 2/2015 | Harman | E21B 43/128 166/105 |
| 2004/0168794 | A1 * | 9/2004 | Vold | E21B 17/025 166/65.1 |
| 2012/0043092 | A1 | 2/2012 | Arizmendi et al. | |
| 2012/0125596 | A1 * | 5/2012 | Homa | E21B 47/123 166/66 |
| 2012/0318494 | A1 | 12/2012 | Michaud et al. | |
| 2013/0094812 | A1 * | 4/2013 | Stoesz | E21B 47/123 385/76 |
| 2014/0060817 | A1 | 6/2014 | Streater et al. | |

* cited by examiner

LOW STRESS ROPE SOCKET FOR DOWNHOLE TOOL

RELATED APPLICATIONS

This application is a U.S. National Stage Application of International Application No. PCT/US2014/051915 filed Aug. 20, 2014, which designates the United States, and is incorporated herein by reference in its entirety.

TECHNICAL FIELD

The present disclosure relates generally to well drilling and hydrocarbon recovery operations and, more particularly, to a low stress rope socket for a downhole tool.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as, for example, drilling a wellbore at a desired well site, treating the wellbore to optimize production of hydrocarbons, and performing the necessary steps to produce and process the hydrocarbons from the subterranean formation.

When performing subterranean operations, it is often desirable to suspend downhole tools from a rope, wire, line, or cable. Tools may be attached to the rope, wire, line, or cable via a clamp or other attachment mechanism. These attachment mechanisms often damage the rope, wire, line, or cable or provide a sub-optimal placement.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

The present disclosure describes a low stress rope socket for use with a downhole tool. The rope socket may be used with a rope, cable, line, or wire which may be suspended in a wellbore. The rope, wire, line, or cable can be a single strand or can be made of multiple strands woven or braided together.

In one example, the rope socket may be used with a slickline. A slickline is a line used to suspend downhole tools in a wellbore and may come in varying lengths, according to the depth of the wellbore. During operation, a downhole tool attached to the slickline may become caught in the wellbore and an operator of the downhole tool may pull on the slickline to bring the tool to the surface. When pulled, the slickline may break at a weak point, resulting in an expensive downhole tool recovery operation. Weak points in the slickline may be located where the slickline bends around a sheave, at a kink in the slickline, or at a clamp where the slickline is attached to the downhole tool. To prevent weak points in the slickline, it may be desirable to avoid bends, kinks, stress, or mechanical damage caused by clamps and sheaves. Accordingly, a system may be designed in accordance with the teachings of the present disclosure to reduce the occurrence of bends, kinks, stress, or mechanical damage to a rope, cable, wire, line, or slickline and improve the efficiency and reduce the cost of using downhole tools. Embodiments of the present disclosure and their advantages are best understood by referring to FIGS. 1 through 8, where like numbers are used to indicate like and corresponding parts.

Figure 1A:
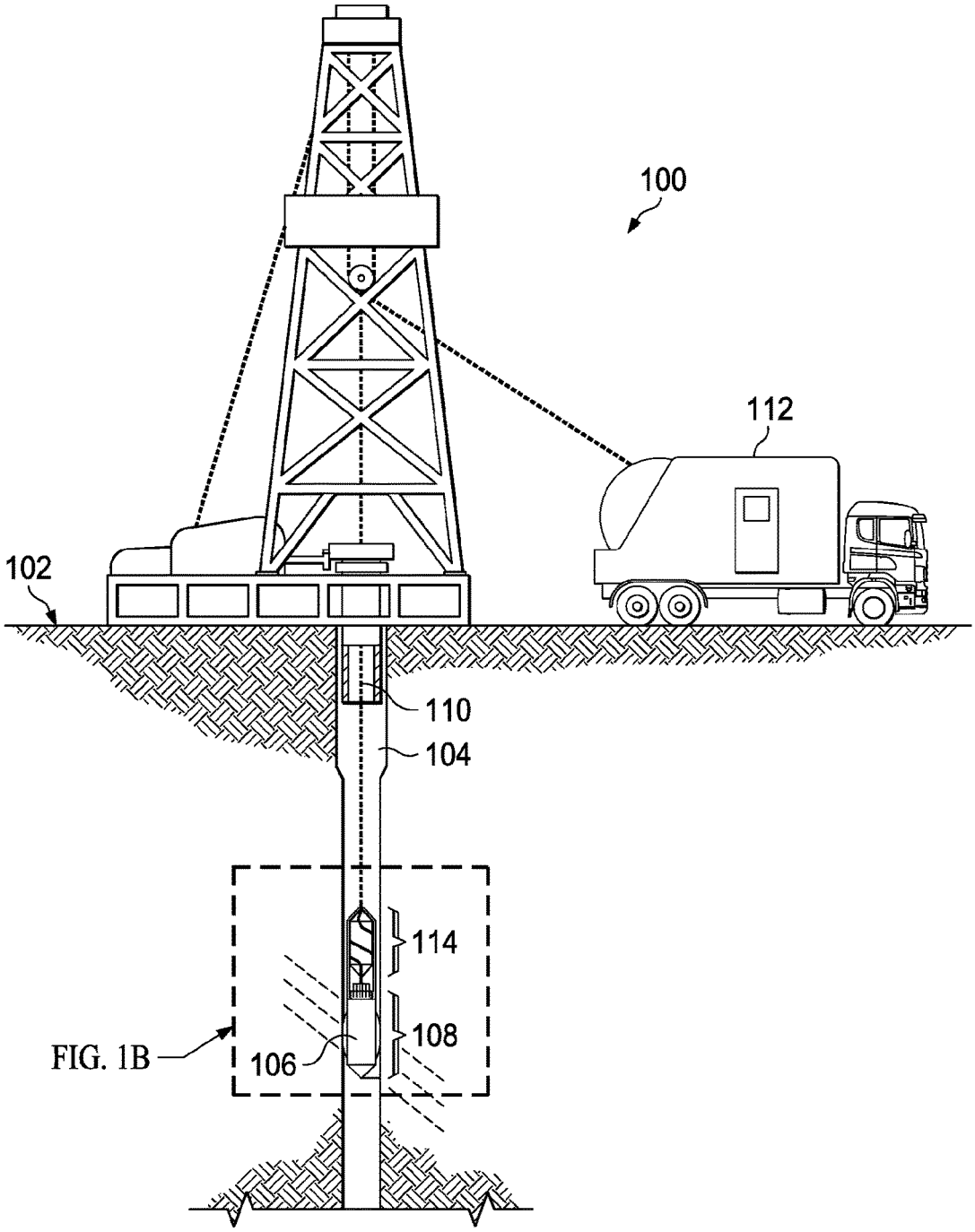
FIG. 1A illustrates an elevation view of an example embodiment of a subterranean operations system used in an illustrative wellbore environment, in accordance with some embodiments of the present disclosure.

FIG. 1A illustrates an elevation view of an example embodiment of subterranean operations system 100 used in an illustrative wellbore environment, in accordance with some embodiments of the present disclosure. Modern petroleum drilling and production operations use ropes, wires, lines, or cables (hereinafter "line") to suspend a downhole tool in a wellbore. Although FIG. 1A shows land-based drilling equipment, downhole drilling tools incorporating teachings of the present disclosure may be satisfactorily used with drilling equipment located on offshore platforms, drill ships, semi-submersibles and drilling barges (not expressly shown). Additionally, while wellbore 104 is shown as being a generally vertical wellbore, wellbore 104 may be any orientation including generally horizontal, multilateral, or directional.

Subterranean operations system 100 may include wellbore 104. "Uphole" may be used to refer to a portion of wellbore 104 that is closer to well surface 102 and "downhole" may be used to refer to a portion of wellbore 104 that is further from well surface 102. Subterranean operations may be conducted using wireline system 106. Wireline system 106 may include one or more downhole tools 108 that may be suspended into wellbore 104 by line 110 (e.g., a cable, slickline, coiled tubing, or rope.) Line 110 may contain one or more conductors for transporting power to wireline system 106 and/or telemetry from downhole tool 108 to logging facility 112. Alternatively, line 110 may lack a conductor, as is often the case using slickline or coiled tubing, and wireline system 106 may contain a control unit that contains memory, one or more batteries, and/or one or more processors for performing operations and storing measurements. Logging facility 112 (shown in FIG. 1A as a truck, although it may be any other structure) may collect measurements from downhole tool 108, and may include computing facilities for controlling, processing, or storing the measurements gathered by downhole tool 108. The computing facilities may be communicatively coupled to downhole tool 108 by way of line 110.

When performing a wireline operation, downhole tool 108 may be coupled to line 110 by rope socket 114, as shown in more detail in FIG. 1A. Line 110 may terminate at rope socket 114 and downhole tool 108 may be coupled to rope socket 114 by a threaded connection. For example, the downhole portion of rope socket 114 may contain threading into which downhole tool 108 may be attached. Downhole tool 108 may be designed such that the orientation of downhole tool 108 may be important. Additionally, line 110 may transmit control signals and/or power to downhole tool 108 and may transmit data from downhole tool 108 to logging facility 112. A kink, bend, stress, and/or mechanical damage in line 110 may decrease the ability of line 110 to transmit signals, power, and data. Therefore, it may be advantageous to attach downhole tool 108 to line 110 in a manner that enables downhole tool 108 to maintain a proper orientation while suspended and prevents any kinks, bends, mechanical damage, or stress on line 110, as discussed in further detail with respect to FIGS. 2-8. For example, rope socket 114 may secure a downhole end of line 110 and may wrap line 110 around rope socket 114 helically to prevent mechanical damage due to kinks, bends, or stress. Additionally rope socket 114 may reduce the stress loading on the termination of line 110 because rope socket 114 carries the load of downhole tool 108 instead of the termination of line 110. Rope socket 114 may consist of a core around which line 110 is wrapped and a housing or a resin to hold line 110 in position on the core of rope socket 114 and a transition to align line 110 to a center axis of rope socket 114 and may include an attachment point to attach downhole tool 108. As such, systems designed according to the present disclosure may enable more efficient and longer lasting lines for use in subterranean operations.

Figure 1B:
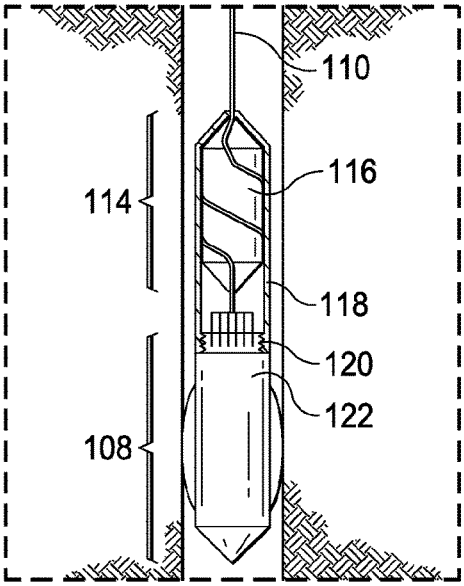
FIG. 1B illustrates a detailed elevation view of a rope socket and a downhole tool of a subterranean operations system, in accordance with some embodiments of the present disclosure.

FIG. 1B illustrates a detailed elevation view of a rope socket 114 and downhole tool 108 of subterranean operations system 100, in accordance with some embodiments of the present disclosure. Rope socket 114 may include core 116 and sleeve 118. Joint 120 may be located at a downhole end of rope socket 114. Joint 120 may be a junction between sleeve 118 and downhole tool 108 and may include any suitable joining mechanism where line 110 may be terminated and downhole tool 108 may be connected to rope socket 114, such as threading. In some embodiments, joint 120 may additionally include electrical joint 122. Electrical joint 122 may allow internal wires of line 110 to be connected to downhole tool 108 without exerting any mechanical stress on the internal wires. In another embodiment, such as a slickline embodiment, line 110 may be terminated at the end of rope socket 114 and may not be attached to downhole tool 108.

Figure 2:
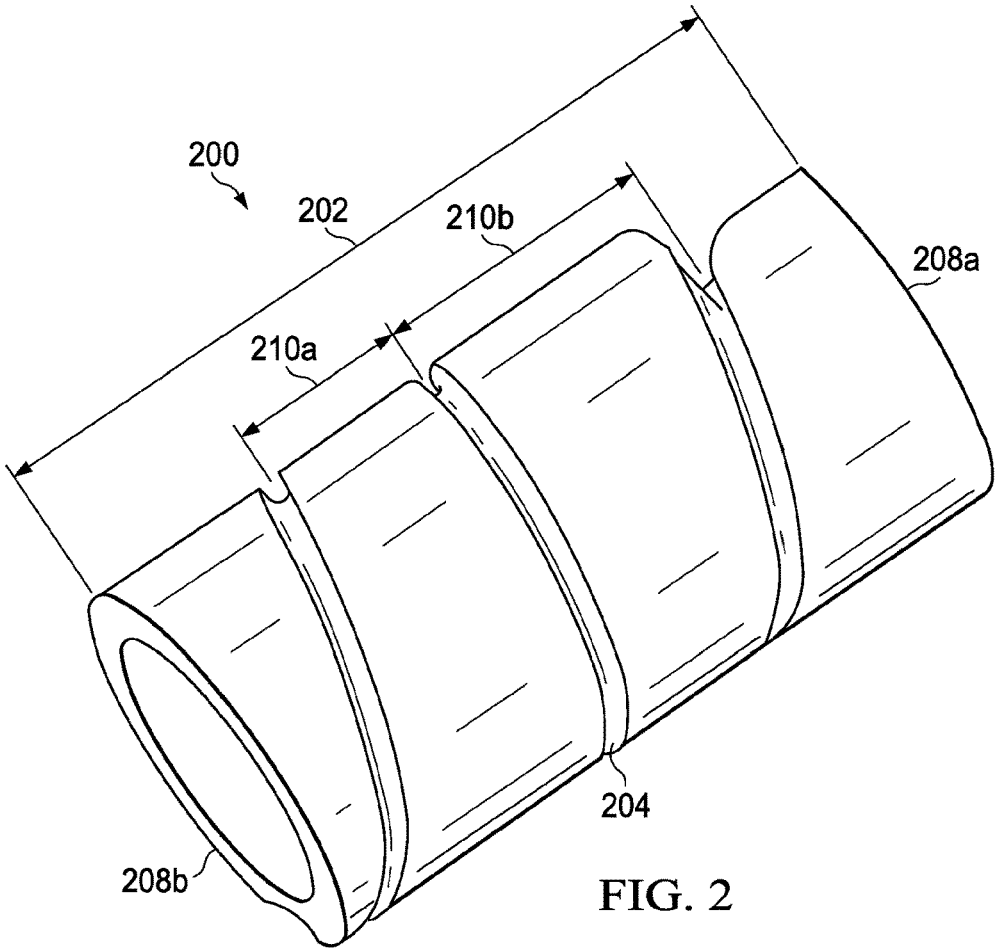
FIG. 2 illustrates a perspective view of a core of a rope socket, in accordance with some embodiments of the present disclosure.

FIG. 2 illustrates a perspective view of core 200 of a rope socket, in accordance with some embodiments of the present disclosure. Core 200 may be a center component of a rope socket, such as rope socket 114 shown in FIGS. 1A and 1B. Core 200 may be made of any suitable material that may withstand the conditions in a wellbore, such as a material used to form drill bit components (e.g., steel, tungsten carbide, or polycrystalline diamond). Core 200 may be a solid or hollow piece of material and may be of any suitable shape having rounded edges, such as cylindrical or elliptical, about which a line may be wrapped. The shape of core 200 may be rounded to avoid kinks or sharp bends in the line when the line is wrapped around core 200. Kinks and/or sharp bends may cause stress and/or mechanical damage to the lines and may prevent the line from functioning properly and may reduce the lifespan of the line.

Length 202 of core 200 may be any suitable distance and may be based on the stiffness of the line to be wrapped around core 200. For example, cables used in subterranean operations may have a high stiffness. Core 200 used with a drilling cable may need to be long to accommodate the stiffness of the drilling cable.

Core 200 may have groove 204 machined or formed in the side of core 200 in which a line, such as line 110 shown in FIGS. 1A and 1B, may be inserted. Groove 204 may be a helical shape which may spiral around core 200. Groove 204 may encircle core 200 any number of times. For example, as shown in FIG. 2, groove 204 encircles core 200 three times. Pitch 210*a* and 210*b* ("pitch 210") of groove 204 (e.g., the width of one complete turn of groove 204, measured parallel to length 202 of core 200) may be based on the stiffness and/or the length of the line to be inserted into groove 204. For example, a line of a longer length or a lesser stiffness may need a lighter pitch. In contrast, a line of a shorter length or a higher stiffness may need a heavier pitch. Pitch 210 of groove 204 may be the same or may vary as groove 204 encircles core 200 from end 208*a* to end 208*b*. For example, pitch 210*a* and 210*b* have different lengths, however, in some embodiments pitch 210 may be constant from end 208*a* to end 208*b*.

Figure 3:
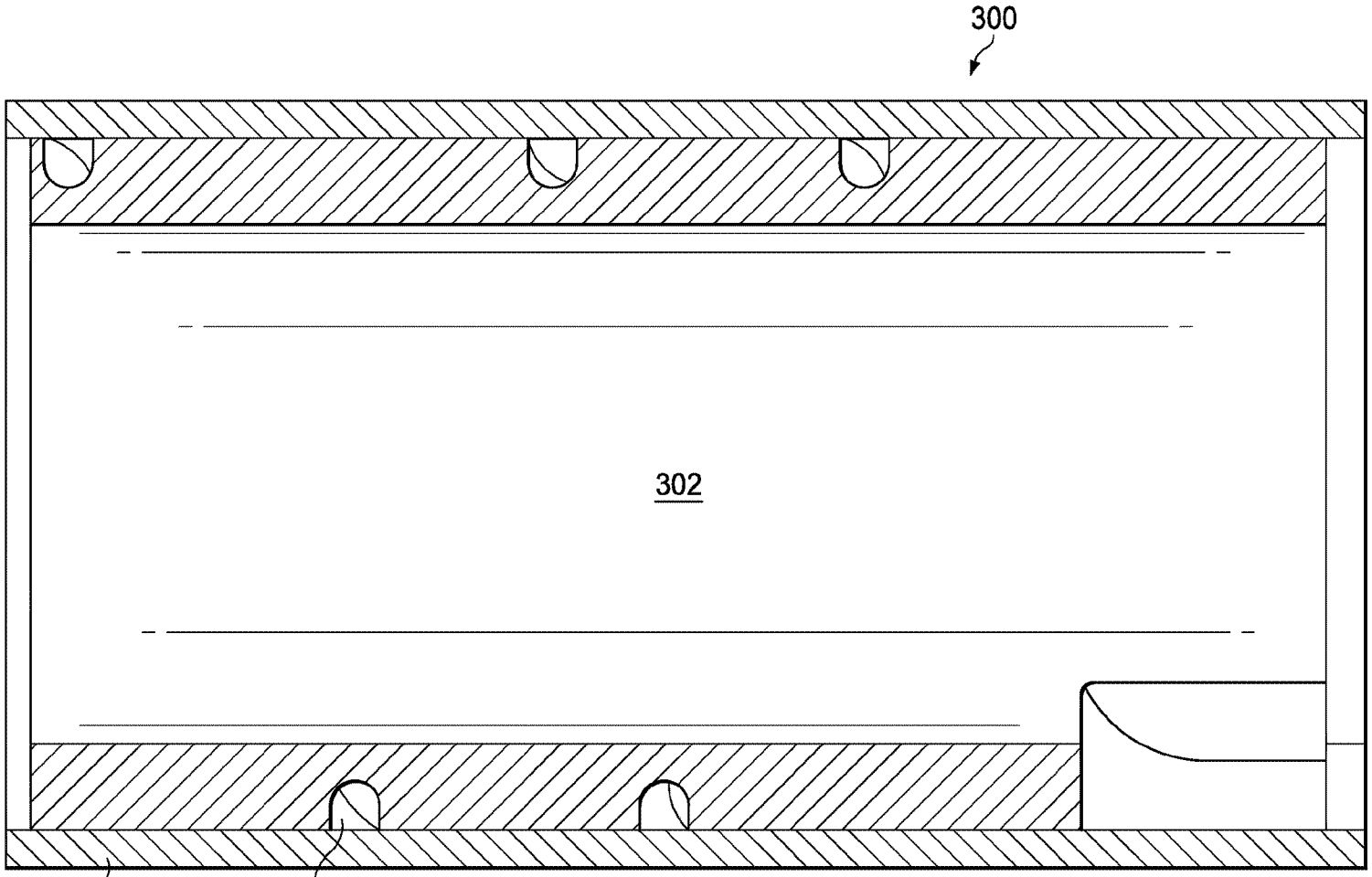
FIG. 3 illustrates a perspective view of a rope socket including a core, a sleeve, and a groove, in accordance with some embodiments of the present disclosure.

FIG. 3 illustrates a perspective view of rope socket 300 including core 302, sleeve 304, and groove 306, in accordance with some embodiments of the present disclosure. Core 302 may have similar characteristics to core 200 shown in FIG. 2. Sleeve 304 may be designed to slide over core 302 to secure a line in groove 306 of core 302. Sleeve 304 may be the same length as core 302, as shown in FIG. 3, or may be shorter or longer than core 302. In embodiments where sleeve 304 is shorter than core 302, sleeve 304 may be long enough to cover a length of groove 306 such that the line is sufficiently secured and the line will not become detached from rope socket 300. Sleeve 304 may have an inner shape similar to the shape of core 302 such that sleeve 304 may slide over core 302. Sleeve 304 and core 302 may be held in place via an interference fit, where the friction between sleeve 304 and core 302 after sleeve 304 is slid over core 302 may keep the two components together without requiring a separate fastener. Sleeve 304 may be made of any suitable material that may withstand the conditions in a wellbore, such as a material used to form drill bit components (e.g., steel, tungsten carbide, or polycrystalline diamond). The thickness of sleeve 304 may be any suitable thickness and may be based on the size of core 302 and the rigidity requirements for sleeve 304.

Figure 4:
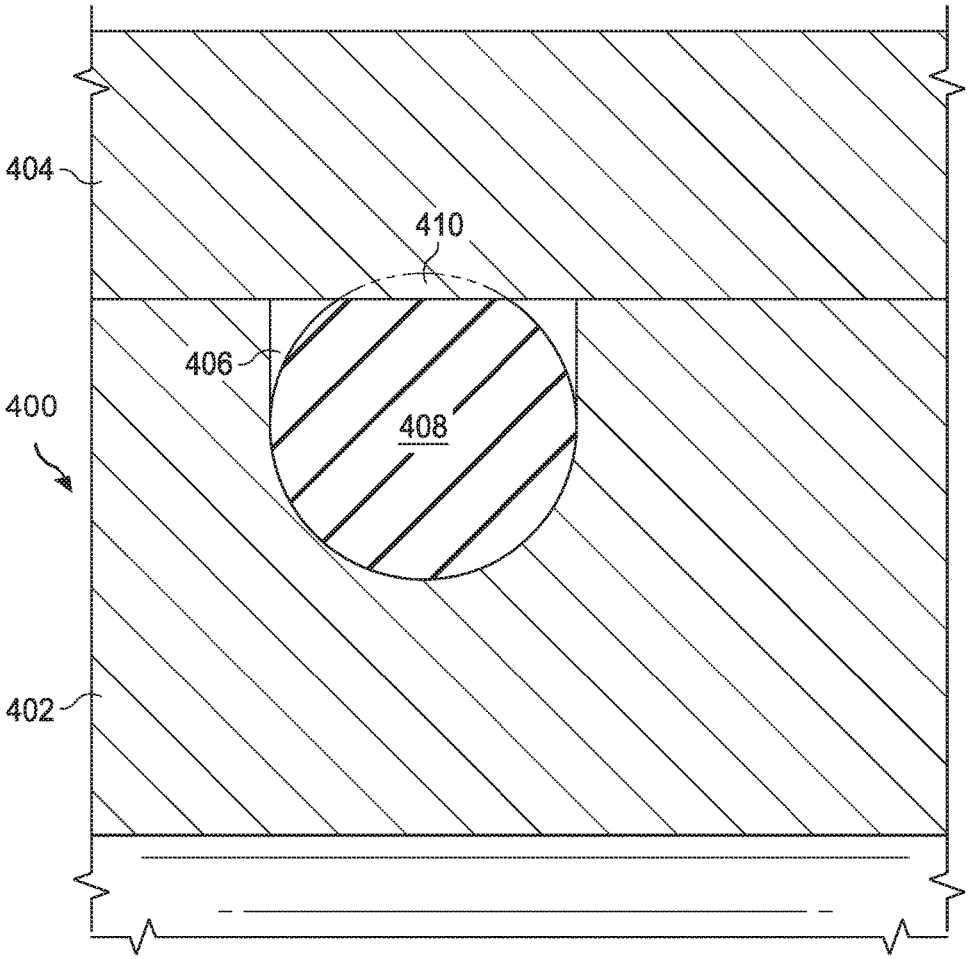
FIG. 4 illustrates a detailed perspective view of a rope socket including a core, a sleeve, a groove and a line, in accordance with some embodiments of the present disclosure.

Sleeve 304 may compress a line inserted in groove 306. FIG. 4 illustrates a detailed perspective view of rope socket 400 including core 402, sleeve 404, groove 406 and line 408, in accordance with some embodiments of the present disclosure. Line 408 may be inserted in groove 406 and wrapped around core 402 from one end of core 402 to the other end of core 402 along groove 406. Once line 408 is wrapped around core 402, sleeve 404 may be slid over core 402 and line 408. Sleeve 404 may compress a portion of line 408, such as section 410, which may correspond to the portion of line 408 that sits above the surface of core 402. By compressing section 410, sleeve 404 may secure line 408 in groove 406 and prevent line 408 from moving while attached to rope socket 400.

Figure 5:
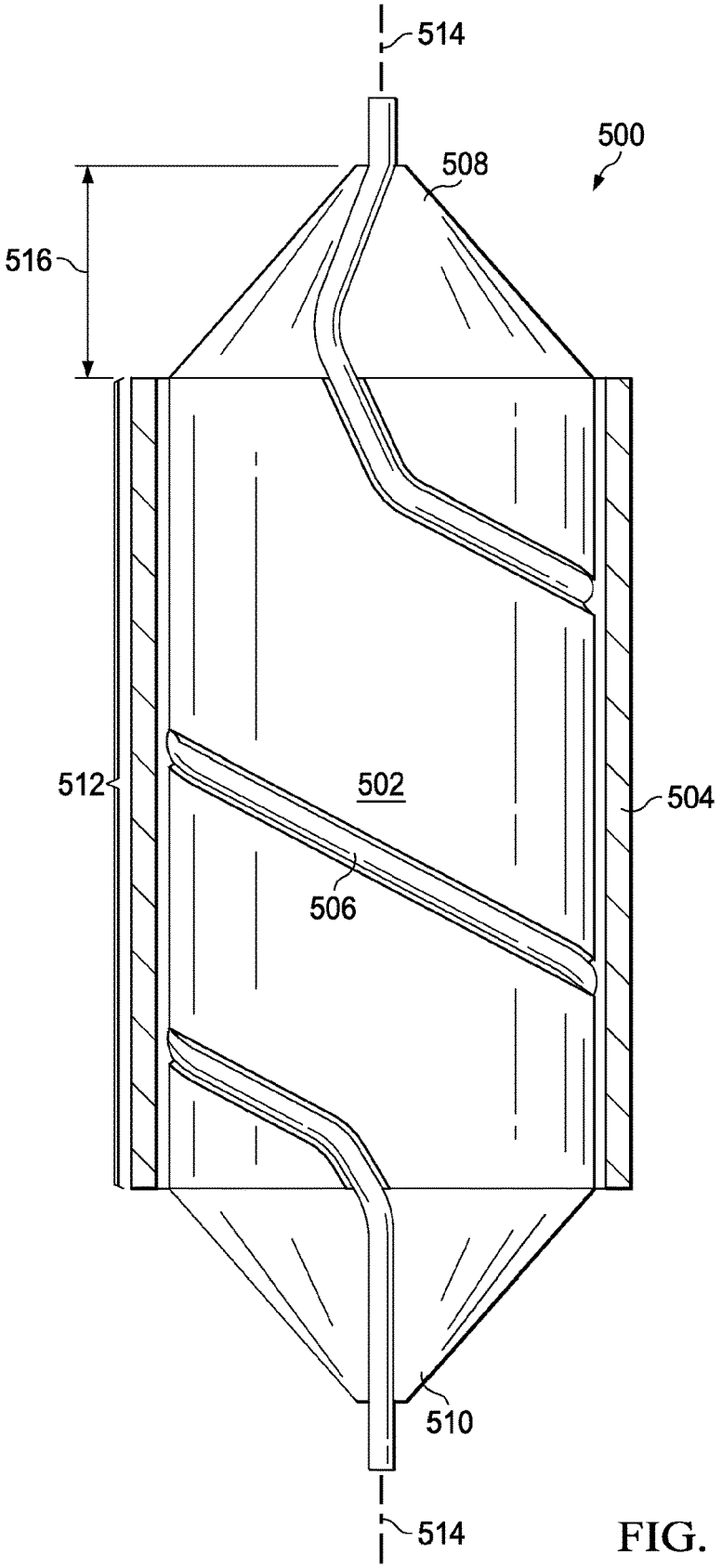
FIG. 5 illustrates a perspective view of a rope socket including a core, a sleeve, a line, and transitions, in accordance with some embodiments of the present disclosure.

FIG. 5 illustrates a perspective view of rope socket 500 including core 502, sleeve 504, line 506, and transitions 508 and 510, in accordance with some embodiments of the present disclosure. Core 502 may have similar characteristics to cores 200, 302, and 402 shown in FIGS. 2-4, respectively. Sleeve 504 may have similar characteristics to sleeves 304 and 404 shown in FIGS. 3 and 4. Line 506 may be inserted in a groove on core 502, as described in more detail with respect to FIGS. 2-4, and may be wrapped around core 502 from one end of core 502 to the opposite end of core 502. Sleeve 504 may be slid over core 502 to compress line 506 and secure line 506 in the groove of core 502.

Rope socket 500 may also include one or more transitions 508 and 510, located at each end of assembly 512. Assembly 512 may include core 502 and sleeve 504. Transitions 508 and 510 may provide a smooth transition of line 506 from the outer diameter of core 502 to center axis 514. Center axis 514 may be an axis of symmetry of rope socket 500. Line 506 may exit rope socket 500 on center axis 514 to enable the rope socket to stay suspended on center axis 514. For example, transition 508 may be located on the uphole end of rope socket 500. Line 506 may exit rope socket 500 via transition 508 and may be aligned with center axis 514 at the uphole end of rope socket 500. When the uphole length of line 506 is aligned with center axis 514, rope socket 500 may be suspended symmetrically along center axis 514. Similarly, transition 510 may be located on the downhole end of rope socket 500. Line 506 may exit rope socket 500 via transition 510 and may be aligned with center axis 514. The downhole length of line 506 may be attached to a downhole tool.

Transitions 508 and 510 may be made of any suitable material that may withstand the conditions in a wellbore, such as a material used to form drill bit components (e.g., steel, tungsten carbide, or polycrystalline diamond) and may be of any suitable shape and height 516 which enables line 506 to smoothly transition from the outer diameter of core 502, such as a cone shape. Transitions 508 and 510 may have rounded edges to prevent introduction of a kink or acute bend in line 506 which may cause stress or mechanical damage to line 506. Further, transitions 508 and 510 may feature a groove machined in transition 508 and 510 (not expressly shown). The groove may be similar to grooves machined in core 502, such as grooves 204, 306, or 406, as shown in FIGS. 2-4, respectively. While transitions 508 and 510 are shown as having similar shapes and sizes, transitions 508 and 510 may be of different shapes and/or different sizes. Additionally rope socket 500 may only have a transition on one end of rope socket 500.

Transition 508 may be include a slickline attachment which may be used to guide a slickline into the grooves of rope socket 500 in embodiments where line 506 is a slickline. The slickline attachment may prevent kinks or bends in the slickline as the slickline transitions from uphole to rope socket 500, which may prevent weak points in the slickline.

Figure 6:
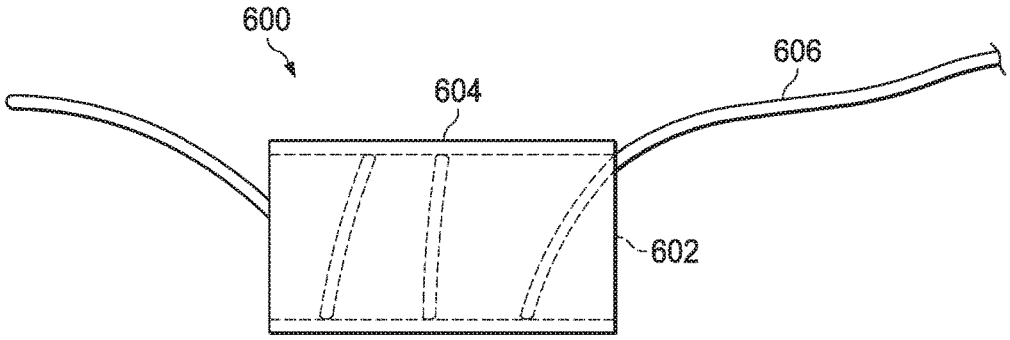
FIG. 6 illustrates a perspective view of a tapered rope socket including a core, a sleeve and a line, in accordance with some embodiments of the present disclosure.

In some embodiments, rope socket 500 may not include a transition on either end of rope socket 500. FIG. 6 illustrates a perspective view of rope socket 600 including core 602, sleeve 604, and line 606, in accordance with some embodiments of the present disclosure. As illustrated, line 606 may be of any length uphole and downhole of rope socket 600. Line 606 may be secured in rope socket 600 by wrapping line 606 around core 602 in grooves (not expressly shown). The wrapping of line 606 may result in the coils of line 606 being unevenly spaced and at unequal pitches, as described in further detail with respect to groove 204 shown in FIG. 2. In the embodiment shown in FIG. 6, rope socket 600 does not include a transition, therefore line 606 may exit rope socket 600 at any location and rope socket 600 may be suspended in a manner not aligned with an axis of symmetry of rope socket 600.

Figure 7:
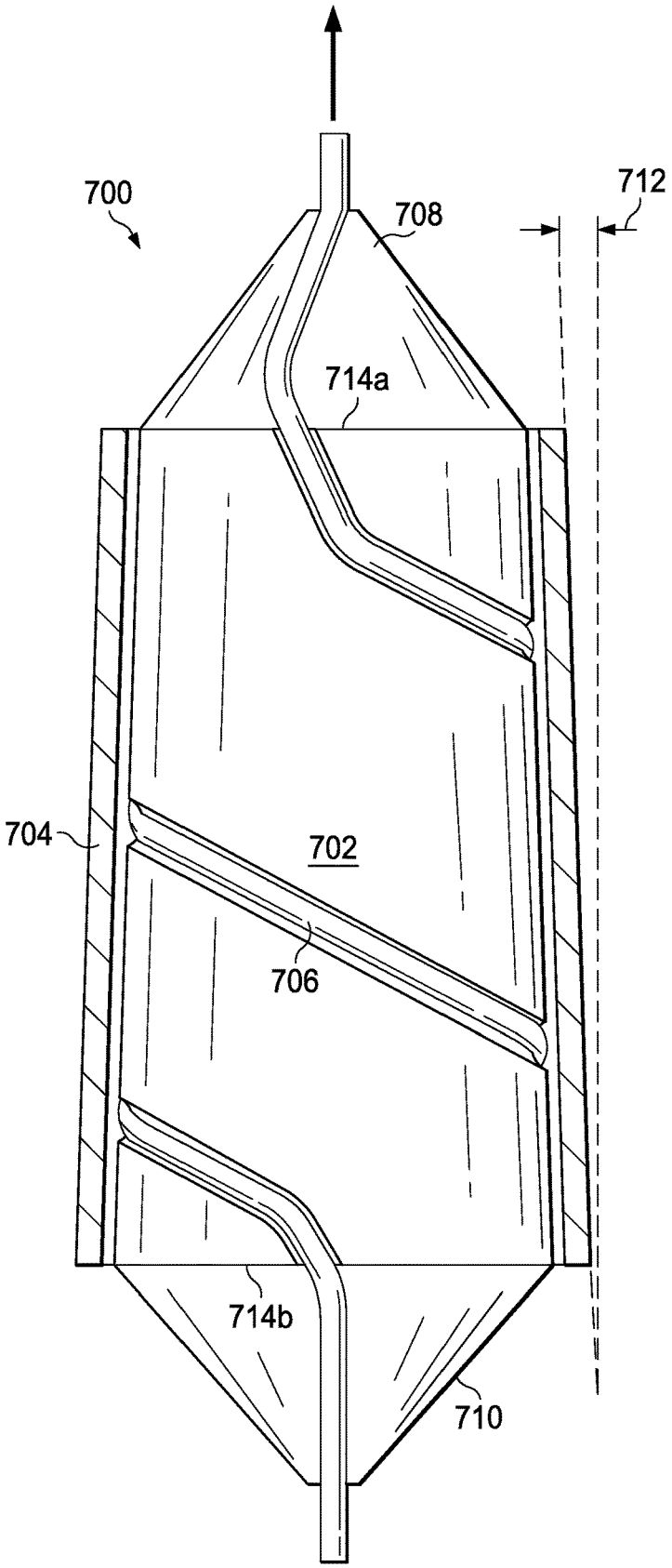
FIG. 7 illustrates a perspective view of a tapered rope socket including a core, a sleeve, a line, and transitions, in accordance with some embodiments of the present disclosure.

In some embodiments, a rope socket may be tapered to reduce the weight of the rope socket. FIG. 7 illustrates a perspective view of tapered rope socket 700 including core 702, sleeve 704, line 706, and transitions 708 and 710, in accordance with some embodiments of the present disclosure. Core 702 may be tapered on an uphole end of core 702. The taper may be equal to angle 712, shown with reference to a vertical axis of rope socket 700. Angle 712 may be any suitable angle such that core 702 retains the rigidity required by the subterranean operation and may endure the downhole conditions in which rope socket 700 may operate. For example, angle 712 may be any angle between zero to forty-five degrees and may depend on the requirements of the subterranean operation. Sleeve 704 may be tapered by a similar angle 712 to match the taper of core 702. In some embodiments, only the inner dimensions of sleeve 704 may be tapered to match core 702 and the outer dimensions of sleeve 704 may remain untapered. The tapering of rope sleeve 700 may also result in increased compression on line 706 due to the tension in line 706 when line 706 is suspended in a wellbore. The tension in line 706 may hold core 702 in place while gravity may force sleeve 704 to slid over core 702 and compress line 706 into the grooves of core 702. The increased compression may be controlled by changing angle 712.

Tapered rope socket 700 may include transitions 708 and 710, which may have similar characteristics to transitions 508 and 510 shown in FIG. 5. However, the size of transition 708 and 710 may be adjusted based on the taper of core 702 and sleeve 704. For example, end 714*a* may have a smaller diameter than end 714*b*. Therefore transition 708 may have a smaller base, where transition 708 meets end 714*a*, than the base of transition 710, where transition 710 meets end 714*b*.

Figure 8:
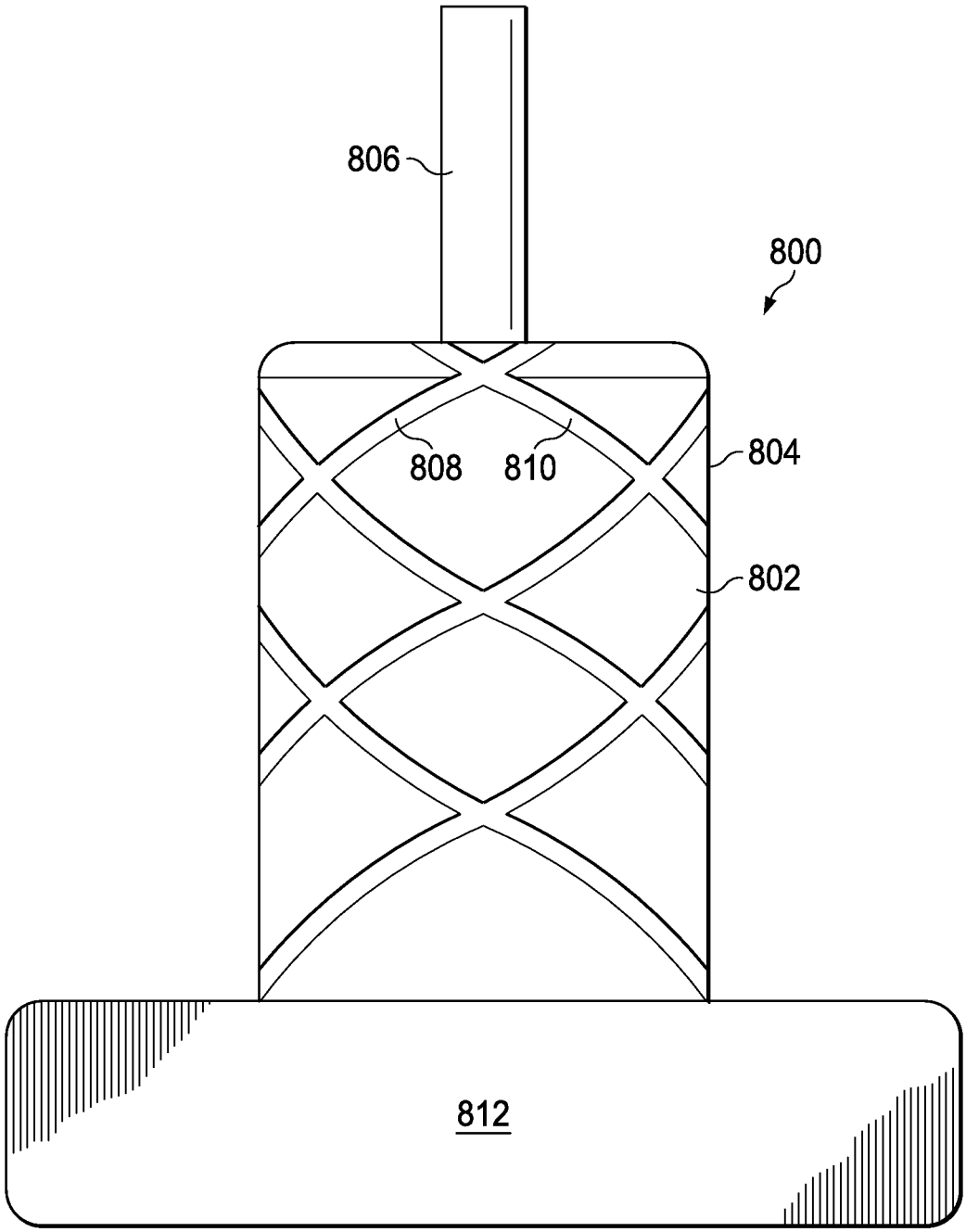
FIG. 8 illustrates a perspective view of a rope socket including a core, a resin coating, a compound line, line strands, and a shoulder, in accordance with some embodiments of the present disclosure.

FIG. 8 illustrates a perspective view of rope socket 800 including core 802, resin coating 804, compound line 806, line strands 808 and 810, and shoulder 812, in accordance with some embodiments of the present disclosure. In some embodiments, compound line 806 may be composed of multiple strands of line which may be braided or woven together to form a single line (e.g., a slickline cable). For example, compound line 806 may be made of line strands 808 and 810. Compound line 806 may be used when a stronger line is required to support a downhole tool or when multiple lines are required to carry different types of signals and/or data. Line strands 808 and 810 may be separated from compound line 806 and each line strand 808 and 810 may be wrapped around core 802 separately.

Core 802 may have similar characteristics as core 200 shown in FIG. 2. However, core 802 may have more than one groove machined into core 802 into which line strands 808 and 810 may be inserted. Wrapping each line strand 808 and 810 around core 802 separately may result in rope socket 800 having more stability than a rope socket where compound line 806 may be wrapped around core 802 without separating compound line 806 into line strands 808 and 810.

In some embodiments, core 802 and line strands 808 and 810 may be covered by a sleeve to secure line strands 808 and 810 against core 802. In other embodiments, core 802 and line strands 808 and 810 may be coated with resin 804. Resin 804 may perform the same function as a sleeve. In embodiments using resin 804, core 802 and line strands 808 and 810 may be coated with resin 804 and cured to harden resin 804. Resin 804 may be any type of epoxy or resin that may be able to withstand the conditions in a wellbore, such as temperature or pressure, and that may not react or corrode in the presence of drilling fluid.

Rope socket 800 may also include shoulder 812 to which a downhole tool may be attached. The size of shoulder 812 may depend on the size or shape of the downhole tool, the size of the wellbore, or any other suitable parameter. Shoulder 812 may be designed such that line strands 808 and 810 may transition from rope socket 800 to the downhole tool without causing kinks, bends, stress, or mechanical damage to line strands 808 and 810. Rope socket 800 may be designed such that shoulder 812 may be removed and replaced with a different shoulder 812, which may have the same or a different shape or size.

While rope socket 800 is shown in FIG. 8 as being untapered, rope socket 800 may be tapered. Rope socket 800 may also include a transition component, similar to transition 508 shown in FIG. 5, to align compound line 806 with an axis of rope socket 800. Resin 804 may also be used in place of sleeve 504 or 704, shown in FIGS. 5 and 7, respectively.

Embodiments disclosed herein include:

A. A low stress rope socket that includes a core, a groove cut in a helix shape on the core, a rope wrapped around the core and inserted in the groove, a slickline attachment affixed to an uphole end of the core to attach the rope to the core, a housing surrounding the rope and the core, the housing securing the rope to the groove, and a transition affixed to a downhole end of the core, the transition aligning the rope with an axis of symmetry of the socket. A portion of the rope downhole from the transition carries no load.

B. A low stress rope socket that includes a core, a groove cut in a helix shape on the core, a rope wrapped around the core and inserted in the groove, a transition affixed to a downhole end of the core, the transition aligning the rope with an axis of symmetry of the socket, and a cured resin coating the core and the rope. A portion of the rope downhole from the transition carries no load.

C. A low stress rope socket that includes a core, a groove cut in a helix shape on the core, a rope wrapped around the core and inserted in the groove, a transition affixed to a downhole end of the core, the transition aligning the rope with an axis of symmetry of the socket, and a sleeve surrounding the rope and the core, the sleeve compressing the rope into the groove. A portion of the rope downhole from the transition carries no load.

Each of embodiments A, B, and C may have one or more of the following additional elements in any combination: Element 1: wherein the housing is a cured resin. Element 2: wherein the housing is a sleeve. Element 3: wherein the rope is a compound rope. Element 4: wherein the rope is a single strand rope. Element 5: wherein the pitch of the groove is even from an end of the core to another end of the core. Element 6: wherein the pitch of the groove is uneven from an end of the core to another end of the core. Element 7: wherein the core is tapered. Element 8: further including a shoulder affixed to an end of the core, wherein the shoulder supports a downhole tool.

Although the present disclosure and its advantages have been described in detail, it should be understood that various changes, substitutions and alterations can be made herein without departing from the spirit and scope of the disclosure as defined by the following claims. For example, while the embodiment discussed describes a core and a sleeve having similar lengths and shapes, the core and the sleeve may have different lengths and different shapes according to the specific use and/or wellbore conditions.

What is claimed is:

1. A low stress rope socket comprising:

a core;

a groove cut in a helix shape on the core;

a rope wrapped around the core and inserted in the groove;

a first transition affixed to an uphole end of the core through which the rope enters the socket, the first transition coaxially aligning the rope with an axis of symmetry of the socket where the rope enters the socket, the first transition comprising a slickline attachment affixed to the uphole end of the core and guiding the rope into the groove;

a housing surrounding the rope and the core, the housing securing the rope to the groove;

a second transition affixed to a downhole end of the core through which the rope exits the socket, the second transition coaxially aligning the rope with the center axis of symmetry of the socket where the rope exits the socket, wherein a portion of the rope downhole from the second transition carries no load; and a shoulder affixed to an end of the core, wherein the shoulder supports a downhole tool.

2. The socket of claim 1, wherein the housing is a cured resin.

3. The socket of claim 1, wherein the housing is a sleeve.

4. The socket of claim 1, wherein the rope is a compound rope.

5. The socket of claim 1, wherein the rope is a single strand rope.

6. The socket of claim 1, wherein the pitch of the groove is even from an end of the core to another end of the core.

7. The socket of claim 1, wherein the pitch of the groove is uneven from an end of the core to another end of the core.

8. The socket of claim 1, wherein the core is tapered.

9. A low stress rope socket comprising:

a core;

a groove cut in a helix shape on the core;

a rope wrapped around the core and inserted in the groove;

a first transition affixed to an uphole end of the core through which the rope enters the socket, the first transition coaxially aligning the rope with an axis of symmetry of the socket where the rope enters the socket;

a second transition affixed to a downhole end of the core through which the rope exits the socket, the second transition coaxially aligning the rope with the center axis of symmetry of the socket where the rope exits the socket;

a cured resin coating the core and the rope, wherein a portion of the rope downhole from the second transition carries no load; and a shoulder affixed to an end of the core, wherein the shoulder supports a downhole tool.

10. The socket of claim 9, wherein the rope is a compound rope.

11. The socket of claim 9, wherein the rope is a single strand rope.

12. The socket of claim 9, wherein the pitch of the groove is even from an end of the core to another end of the core.

13. The socket of claim 9, wherein the pitch of the groove is uneven from an end of the core to another end of the core.

14. The socket of claim 9, wherein the core is tapered.

15. A low stress rope socket comprising:

a core;

a groove cut in a helix shape on the core;

a rope wrapped around the core and inserted in the groove;

a first transition affixed to an uphole end of the core through which the rope enters the socket, the first transition coaxially aligning the rope with an axis of symmetry of the socket where the rope enters the socket;

a second transition affixed to a downhole end of the core through which the rope exists the socket, the second transition coaxially aligning the rope with the center axis of symmetry of the socket where the rope exits the socket;

a sleeve surrounding the rope and the core, the sleeve compressing the rope into the groove, wherein a portion of the rope downhole from the second transition carries no load; and a shoulder affixed to an end of the core, wherein the shoulder supports a downhole tool.

16. The socket of claim 15, wherein the rope is a compound rope.

17. The socket of claim 15, wherein the rope is a single strand rope.

18. The socket of claim 15, wherein the pitch of the groove is even from an end of the core to another end of the core.

19. The socket of claim 15, wherein the pitch of the groove is uneven from an end of the core to another end of the core.

20. The socket of claim 15, wherein the core is tapered.

* * * * *